US009781961B2

(12) United States Patent
Erickson

(10) Patent No.: US 9,781,961 B2
(45) Date of Patent: Oct. 10, 2017

(54) NECKTIE SYSTEM

(71) Applicant: Louis Erickson, Rush Valley, UT (US)

(72) Inventor: Louis Erickson, Rush Valley, UT (US)

( * ) Notice: Subject to any disclaimer, the term of this patent is extended or adjusted under 35 U.S.C. 154(b) by 111 days.

(21) Appl. No.: 14/796,025

(22) Filed: Jul. 10, 2015

(65) Prior Publication Data

US 2017/0006944 A1 Jan. 12, 2017

(51) Int. Cl.

| | |
|---|---|
| ***A41D 25/00*** | (2006.01) |
| ***A41D 25/10*** | (2006.01) |
| ***A41D 25/12*** | (2006.01) |
| ***A41D 25/16*** | (2006.01) |
| ***A41D 25/02*** | (2006.01) |
| ***A44B 6/00*** | (2006.01) |

(52) U.S. Cl.

CPC ..... *A41D 25/027* (2013.01); *A41D 25/003* (2013.01); *A41D 25/005* (2013.01); *A41D 25/006* (2013.01); *A41D 25/025* (2013.01); *A41D 25/10* (2013.01); *A44B 6/00* (2013.01)

(58) Field of Classification Search

CPC .... A41D 25/00; A41D 25/003; A41D 25/005; A41D 25/006; A41D 25/02; A41D 25/022; A41D 25/025; A41D 25/10; A41D 25/12; A41D 25/14; A41D 25/027; A44B 6/00; Y10T 24/19; Y10T 24/1914; Y10T 24/1966; Y10T 24/199; Y10T 24/1997

USPC ..... 2/144, 145, 148, 156; 24/49.1, 66.3, 24/66.11, 66.13

See application file for complete search history.

(56) References Cited

U.S. PATENT DOCUMENTS

| | | | | | |
|---|---|---|---|---|---|
| 3,745,614 | A * | 7/1973 | Tsang | A41D 25/022 | 2/148 |
| 4,173,792 | A * | 11/1979 | Intengan | A41D 25/025 | 2/144 |
| 4,504,979 | A * | 3/1985 | Kawamura | A41D 25/14 | 2/144 |
| 4,771,481 | A | 9/1988 | Gasser | | |
| 5,010,593 | A * | 4/1991 | Stevens, Jr. | A41D 25/022 | 2/148 |
| 5,088,120 | A | 2/1992 | Yen | | |
| 5,216,757 | A * | 6/1993 | Dorkin | A41D 25/022 | 2/144 |
| 5,461,726 | A | 10/1995 | Wade | | |
| 5,493,731 | A * | 2/1996 | Amnott | A41D 25/022 | 2/148 |
| 5,774,893 | A | 7/1998 | Torres | | |
| 5,836,018 | A * | 11/1998 | Lee | A61N 2/06 | 2/144 |
| 6,401,251 | B1 | 6/2002 | Fredenberg | | |
| 6,460,189 | B1 * | 10/2002 | Welch | A41D 25/02 | 2/145 |

(Continued)

FOREIGN PATENT DOCUMENTS

| | | | | |
|---|---|---|---|---|
| DE | 10112036 C1 * | 4/2002 | | A41D 25/022 |
| FR | WO 2008110701 A2 * | 9/2008 | | A41D 25/025 |

*Primary Examiner* — Jameson Collier

(57) ABSTRACT

A necktie system includes a necktie that may be worn around a neck of a user. A first fastener is attached to the necktie and a pair of cups is provided. Each of the cups is mateable such that the pair of cups forms a housing. The housing has the necktie extended therethrough such that the housing retains the necktie around the user's neck. A second fastener is attached to the one of the cups. The first fastener removably engages the second fastener such that the housing is retained in the necktie.

10 Claims, 3 Drawing Sheets

(56) References Cited

U.S. PATENT DOCUMENTS

| | | | | |
|---|---|---|---|---|
| 7,096,509 | B2 | 8/2006 | Kim | |
| 7,373,696 | B2 * | 5/2008 | Schoening | A41D 25/003 24/303 |
| D688,836 | S | 8/2013 | Costello | |

* cited by examiner

NECKTIE SYSTEM

BACKGROUND OF THE DISCLOSURE

Field of the Disclosure

The disclosure relates to necktie devices and more particularly pertains to a new necktie device to facilitate a necktie to be worn without a knot.

SUMMARY OF THE DISCLOSURE

An embodiment of the disclosure meets the needs presented above by generally comprising a necktie that may be worn around a neck of a user. A first fastener is attached to the necktie and a pair of cups is provided. Each of the cups is mateable such that the pair of cups forms a housing. The housing has the necktie extended therethrough such that the housing retains the necktie around the user's neck. A second fastener is attached to the one of the cups. The first fastener removably engages the second fastener such that the housing is retained in the necktie.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
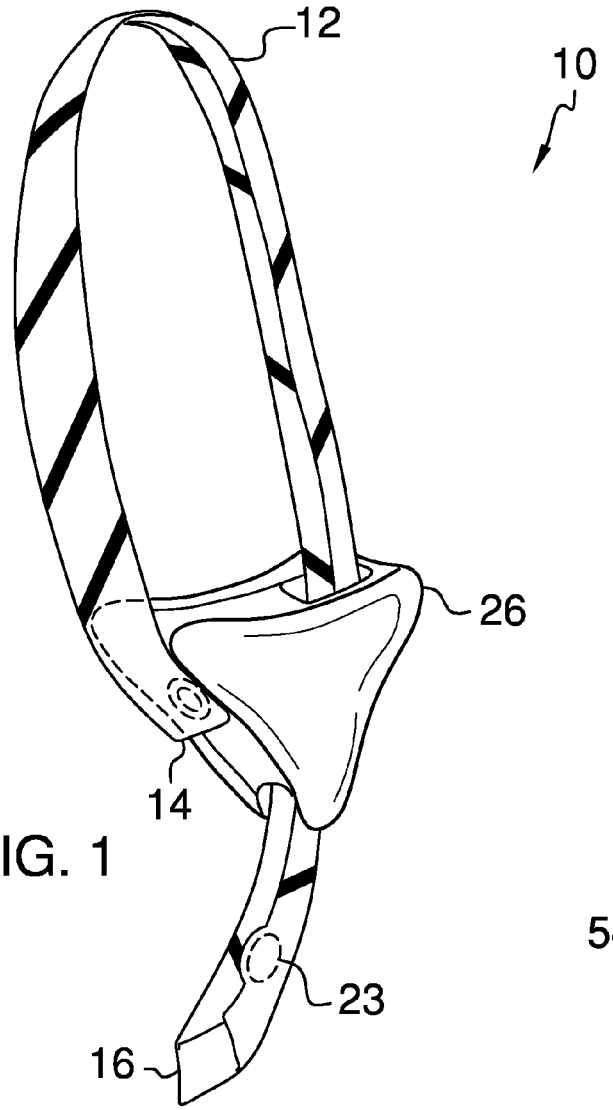
FIG. 1 is a perspective view of a necktie system according to an embodiment of the disclosure.
Figure 2:
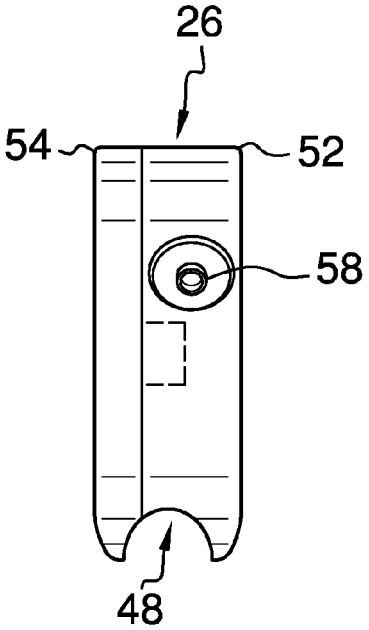
FIG. 2 is a right side view of an embodiment of the disclosure.
Figure 3:
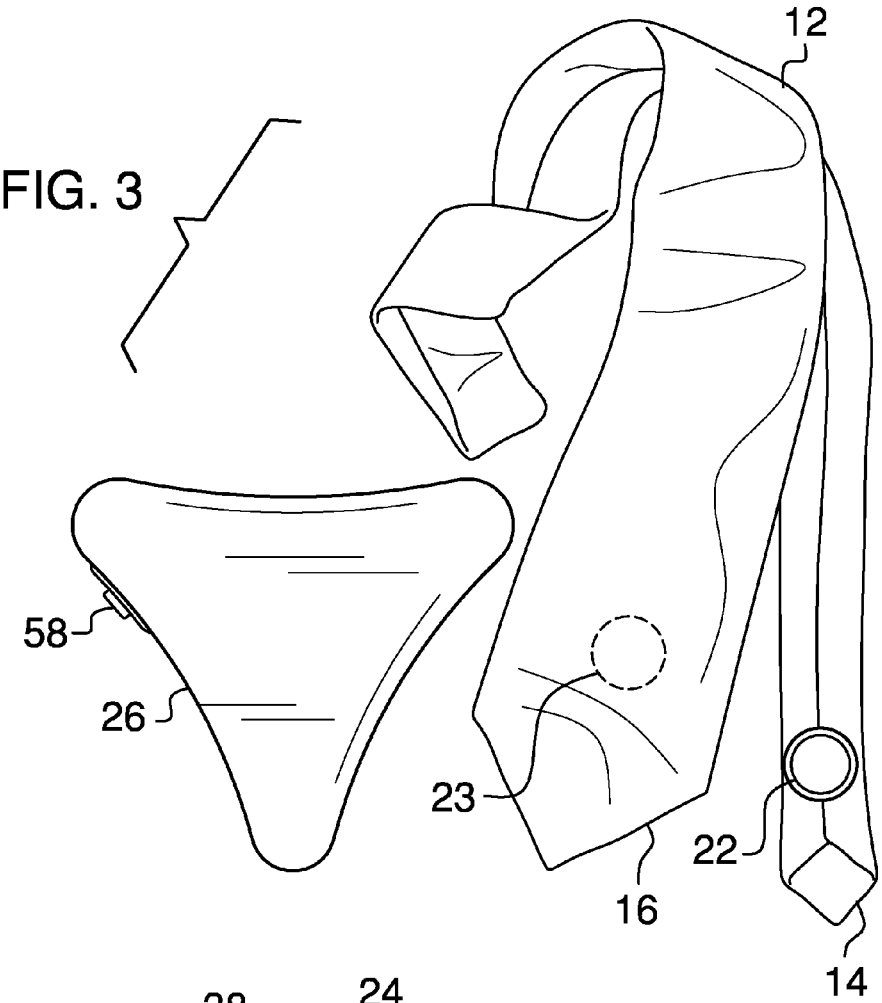
FIG. 3 is a kit view of an embodiment of the disclosure.
Figure 4:
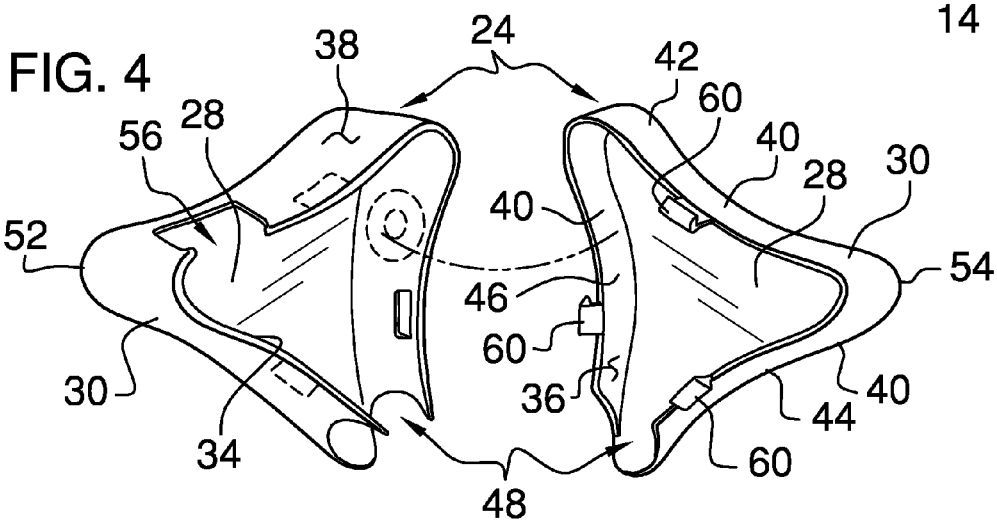
FIG. 4 is a exploded perspective view of an embodiment of the disclosure.
Figure 5:
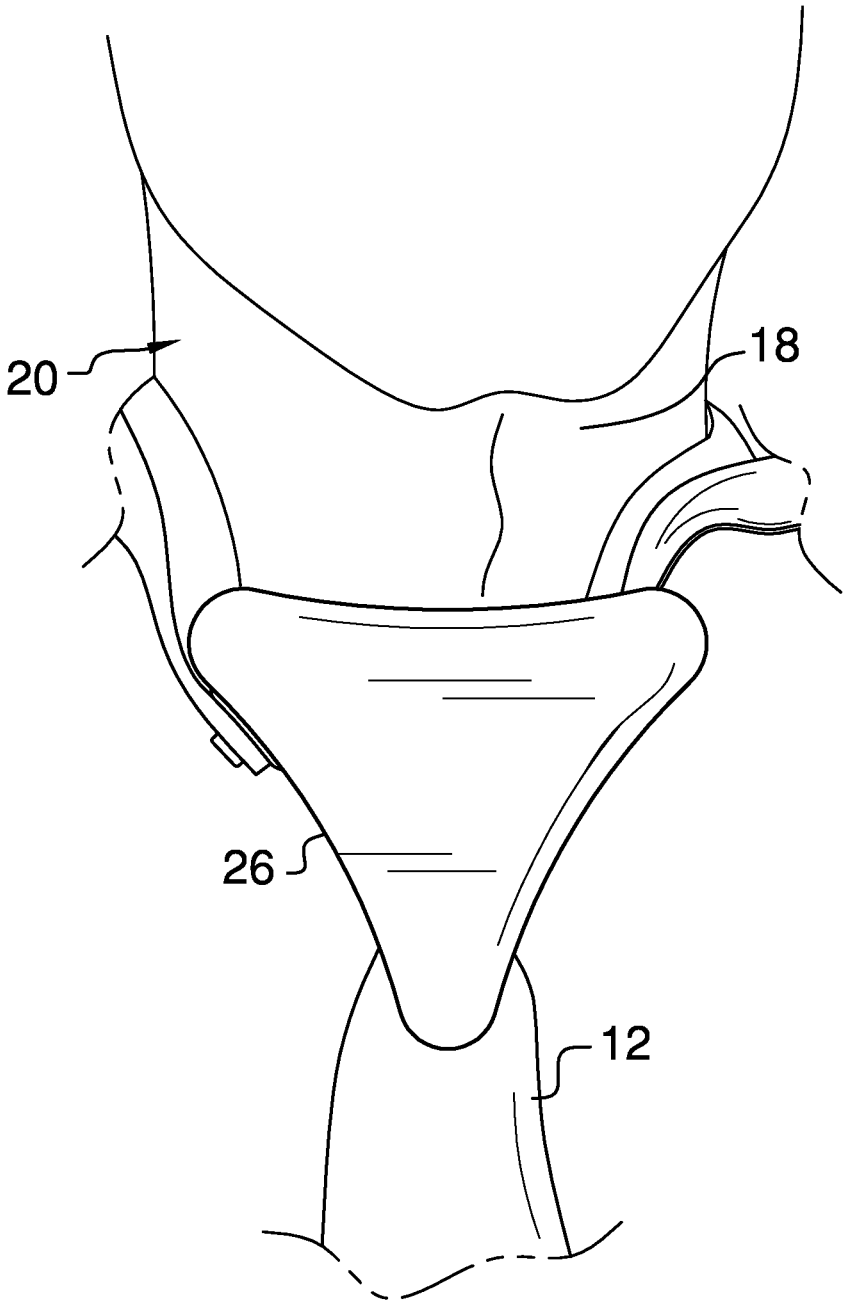
FIG. 5 is a perspective in-use view of an embodiment of the disclosure.

With reference now to the drawings, and in particular to FIGS. 1 through 5 thereof, a new necktie device embodying the principles and concepts of an embodiment of the disclosure and generally designated by the reference numeral 10 will be described.

As best illustrated in FIGS. 1 through 5, the necktie system 10 generally comprises a necktie 12 that has a first end 14 and a second end 16. The necktie 12 is elongated between the first end 14 and the second end 16 and the necktie 12 may be worn around a neck 18 of a user 20. A first fastener 22 is attached to the necktie 12 and the first fastener 22 is positioned proximate the first end 14. The first fastener 22 may comprise a snap or the like. A stop 23 is coupled to the necktie 12. The stop 23 is positioned within the necktie 12 and the stop 23 is positioned proximate the second end 16.

A pair of cups 24 is provided and each of the cups 24 is mateable to form a housing 26. The housing 26 has the necktie extended therethrough such that the housing 26 retains the necktie 12 around the user's neck 18. The housing 26 serves to replace a knot in the necktie 12 in both appearance and function.

Each of the cups 24 has a first wall 28 and a peripheral wall 30 that is coupled to and extends away from an outer edge 32 of the first wall 28. The peripheral wall 30 of each of the cups 24 has a distal edge 34 with respect to the first wall 28 of an associated one of the cups 24. The peripheral wall 30 of each of the cups 24 has an inwardly facing surface 36 and an outwardly facing surface 38. The peripheral wall 30 of each of the cups 24 has a plurality of intersecting sides 40 such that each of the cups 24 has a triangular shape. The plurality of intersecting sides 40 of each of the cups 24 includes a first side 42, a second side 44 and a third side 46. The triangular shape of each of the cups 24 enhances the knot-like appearance of each of the cups 24. The first side 42, the second side 44 and the third side 46 of each of the cups 24 curve inwardly toward a center of each of the cups 24.

The peripheral wall 30 of each of the cups 24 has a lower opening 48 extending through the inwardly facing surface 36 and the outwardly facing surface 38. The lower opening 48 on each of the cups 24 is positioned at an intersection of the second side 44 and the third side 46 of each of the cups 24. The pair of cups 24 includes a first one of the cups 52 and a second one of the cups 54 and the peripheral wall 30 of the first cup 52 has an upper opening 56 extending through the inwardly facing surface 36 and the outwardly facing surface 38. The upper opening 56 is positioned adjacent to an intersection of the first side 42 and the third side 46 of the first cup 52. The lower opening 48 in the first cup 52 is aligned with the lower opening 48 in the second cup 54 when the first cup 52 is mated to the second cup 54.

A second fastener 58 is attached to the one of the cups 24 and the first fastener 22 removably engages the second fastener 58 such that the housing 26 is retained on the necktie 12. The second fastener 58 may comprise a snap or the like. The second fastener 58 is positioned on the outwardly facing surface 38 corresponding to the first cup 52 and the second fastener 58 is positioned adjacent to an intersection of the first side 42 and the second side 44 corresponding to the first cup 52. The stop 23 engages the housing 26 when the necktie 12 is drawn through the housing 26 such that the second end 16 is prevented from being removed from the housing 26.

A plurality of tabs 60 is provided and each of the tabs 60 is attached to the second cup 54. Each of the tabs 60 is positioned on the distal edge 34 of the second cup 54 and each of the tabs 60 is positioned on an associated one of the first side 42, the second side 44 and the third side 46 corresponding to the second cup 54. Each of the tabs 60 engage the inwardly facing surface 36 corresponding to the first cup 52 when the second cup 54 is mated to the first cup 52 such that the second cup 54 is removably retained on the first cup 52.

In use, the second end 16 of the necktie 12 is directed through the upper opening 56 and the lower opening 48 corresponding to the first cup 52. The second cup 54 is mated to the first cup 52 when the necktie 12 is extended through the first cup 52 and the first fastener 22 is coupled to the second fastener 58. The necktie 12 is drawn through the housing 26 thereby facilitating the necktie 12 to be tightened around the user's neck 18. The housing 26 frictionally engages the necktie 12 thereby facilitating the housing 26 to be retained at a selected point along the necktie 12. The housing 26 facilitates the necktie 12 to be worn without tying a knot in the necktie 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A necktie system comprising:

a necktie being configured to be worn around a neck of a user;

a first fastener being attached to said necktie, a pair of cups, each of said cups being mateable to one another such that said pair of cups forms a housing when mated together, said housing having said necktie being extended therethrough wherein said housing is configured to retain said necktie around the user's neck;

a second fastener being attached to one of said cups, said first fastener removably engaging said second fastener such that said housing is retained on said necktie;

said pair of cups including a first cup and a second cup, said second cup having a distal edge, a first side, a second side and a third side, said first cup having an inwardly facing surface; and a plurality of tabs, each of said tabs being attached to said second cup, each of said tabs being positioned on said distal edge of said second cup, each of said tabs being positioned on an associated one of said first side, said second side and said third side corresponding to said second cup, each of said tabs engaging said inwardly facing surface corresponding to said first cup when said second cup is mated to said first cup such that said second cup is removably retained on said first cup.

2. The system according to claim 1, wherein:

said necktie has a first end and a second end, said necktie being elongated between said first end and said second end; and said first fastener is positioned proximate said first end.

3. The system according to claim 1, wherein each of said cups has a first wall and a peripheral wall being coupled to and extending away from an outer edge of said first wall, said peripheral wall of each of said cups having a distal edge with respect to said first wall of an associated one of said cups, said peripheral wall of each of said cups having an inwardly facing surface and an outwardly facing surface.

4. The system according to claim 3, wherein said peripheral wall of each of said cups has a plurality of intersecting sides such that each of said cups has a triangular shape, said plurality of intersecting sides of each of said cups including a first side, a second side and a third side, said first side, said second side and said third side of each of said cups curving inwardly toward a respective center of each of said cups.

5. The system according to claim 4, wherein said peripheral wall of each of said cups has a lower opening extending through said inwardly facing surface and said outwardly facing surface, said lower opening on each of said cups being positioned at an intersection of said second side and said third side.

6. The system according to claim 5, wherein, said peripheral wall of said first cup having an upper opening extending through said inwardly facing surface and said outwardly facing surface, said upper opening being positioned adjacent to an intersection of said first side and said third side of said first cup.

7. The system according to claim 6, wherein:

said necktie has a first end and a second end; and said second end of said necktie being directed through said upper opening and said lower opening corresponding to said first cup, said second cup being mated to said first cup when said necktie is extended through said first cup.

8. The system according to claim 6, further comprising a stop being attached to said necktie, said stop being positioned proximate said second end, said stop engaging said housing such that said second end is prevented from being removed from said housing.

9. The system according to claim 1, wherein:

said first cup having an outwardly facing surface, a first side and a second side; and said second fastener is positioned on said outwardly facing surface corresponding to said first cup, said second fastener being positioned adjacent to an intersection of said first side and said second side corresponding to said first cup.

10. A necktie system comprising:

a necktie having a first end and a second end, said necktie being elongated between said first end and said second end, said necktie being configured to be worn around a neck of a user;

a first fastener being attached to said necktie, said first fastener being positioned proximate said first end;

a stop being attached to said necktie, said stop being positioned proximate said second end;

a pair of cups, each of said cups being mateable with one another such that said pair of cups forms a housing when mated together, said housing having said necktie being extended therethrough wherein said housing is configured to retain said necktie around the user's neck, each of said cups having a first wall and a peripheral wall being coupled to and extending away from an outer edge of said first wall, said peripheral wall of each of said cups having a distal edge with respect to said first wall of an associated one of said cups, said peripheral wall of each of said cups having an inwardly facing surface and an outwardly facing surface, said peripheral wall of each of said cups having a plurality of intersecting sides such that each of said cups has a triangular shape, said plurality of intersecting sides of each of said cups including a first side, a second side and a third side, said first side, said second side and said third side of each of said cups curving inwardly toward a respective center of each of said cups, said peripheral wall of each of said cups having a lower opening extending through said inwardly facing surface and said outwardly facing surface, said lower opening on each of said cups being positioned at an intersection of said second side and said third side, said pair of cups including a first one of said cups and a second one of said cups, said peripheral wall of said first cup having an upper opening extending through said inwardly facing surface and said outwardly facing surface, said upper opening being positioned adjacent to an intersection of said first side and said third side of said first cup, said second end of said necktie being directed through said upper opening and said lower opening corresponding to said first cup, said second cup being mated to said first cup when said necktie is extended through said first cup, said stop engaging said housing such that said second end is prevented from being removed from said housing;

a second fastener being attached to one of said cups, said first fastener removably engaging said second fastener such that said housing is retained in said necktie, said second fastener being positioned on said outwardly facing surface corresponding to said first cup, said second fastener being positioned adjacent to an intersection of said first side and said second side corresponding to said first cup; and a plurality of tabs, each of said tabs being attached to said second cup, each of said tabs being positioned on said distal edge of said second cup, each of said tabs being positioned on an associated one of said first side, said second side and said third side corresponding to said second cup, each of said tabs engaging said inwardly facing surface corresponding to said first cup when said second cup is mated to said first cup such that said second cup is removably retained on said first cup.

* * * * *